United States Patent [19]

Wilcox et al.

[11] 4,380,293

[45] Apr. 19, 1983

[54] SOCKET WRENCH DISPLAY PACKAGE

[75] Inventors: Donald G. Wilcox, Seymour; Nobile Zambrano, Branford, both of Conn.

[73] Assignee: Show-Pak, Incorporated, New Haven, Conn.

[21] Appl. No.: 216,327

[22] Filed: Dec. 15, 1980

[51] Int. Cl.[3] ..... B65D 73/02

[52] U.S. Cl. ..... 206/563; 206/564; 206/214; 206/378

[58] Field of Search ..... 206/214, 44.11, 372, 206/373, 374, 375, 376, 377, 378, 327, 339, 564, 563, 562, 486; 190/51

[56] References Cited

U.S. PATENT DOCUMENTS

| | | | |
|---|---|---|---|
| 3,013,656 | 12/1961 | Murphy, Jr. | 206/563 X |
| 3,724,654 | 4/1973 | Gerard et al. | 206/564 X |
| 4,210,243 | 7/1980 | McDowell | 206/564 X |

*Primary Examiner*—Steven M. Pollard

*Attorney, Agent, or Firm*—Curtis, Morris & Safford

[57] ABSTRACT

A blow molded display package and case has a plastic base including upper and lower spaced walls and a peripheral side therebetween with the upper wall having a plurality of depressions or recesses formed therein separated by surface portions lying in a common plane. The depressions have a predetermined configuration selected according to the configuration of objects to be placed therein such that the objects extend above the depressions no further than the plane of the support surface portions. A transparent cover plate overlies the upper wall and is supported on the support surface portions against the objects in the recesses to retain the objects therein. The upper wall of the base also includes at least one frustro-conical depression formed therein having a base portion sealed to the lower wall of the base and a key hole shaped knock-out formed therein, thereby to rigidify the base while providing means for mounting the case on a wall.

5 Claims, 4 Drawing Figures

SOCKET WRENCH DISPLAY PACKAGE

The present invention relates to package construction and more particularly to a combination package and display case.

The present invention provides an article which is adapted to be used both as a storage container and a display case. It is particularly adapted to contain a socket wrench set in an array used for display at a merchandising center and also as a storage container for the consumer.

The combination package and display case is formed of blow molded plastic material in a relatively inexpensive operation. However, it is constructed to be relatively rigid so that it can be made in relatively large sizes to support the numerous and relatively heavy components of a multi-part socket wrench set. More specifically, the package includes a blow molded plastic base which has spaced upper and lower walls and a peripheral wall extending therebetween. The upper wall has a first set of frusto-conical depressions formed therein open at the upper wall of the base and themselves having bases sealed to the lower wall of the base in order to provide reinforcement for the walls and rigidify the blow molded base. The upper wall has a second set of depressions formed in predetermined shapes and defining flat wall portions therebetween, all of which lie on the same plane. These flat wall portions serve to support a transparent cover for the package.

The second set of depressions are dimensioned with respect to the objects to be received therein, namely the components of the socket wrench set, such that the outermost surfaces of the objects in the depressions lie in the same plane. The transparent cover panel is removably secured to the upper wall against these objects and holds them in place.

Although these depressions are described in this illustrative embodiment with particular reference to a socket wrench set, it is to be understood that the construction of the invention may be arranged to accomodate articles other than socket wrenches.

At least one of the frustro-conical depressions in the upper wall of the base has a key hole shaped knock-out formed in its base, and in the lower wall of the package, to enable the package to be suspended on nails or hooks or the like for display purposes.

It is an object of the present invention to provide a blow molded package which can be used to both store and display a plurality of articles.

Another object of the present invention is to provide a display case which is relatively simple and inexpensive in construction yet durable in use.

A further object of the present invention is to provide a blow molded display case which is relatively rigid and can support a plurality of numerous, relatively heavy articles.

A further object of the present invention is to provide a blow molded display case which can be hung from a wall rack or the like.

The above, and other objects, features and advantages of this invention will be apparent in the following detailed description of an illustrative embodiment thereof, which is to be read in connection with the accompanying drawings, wherein.

Figure 1:
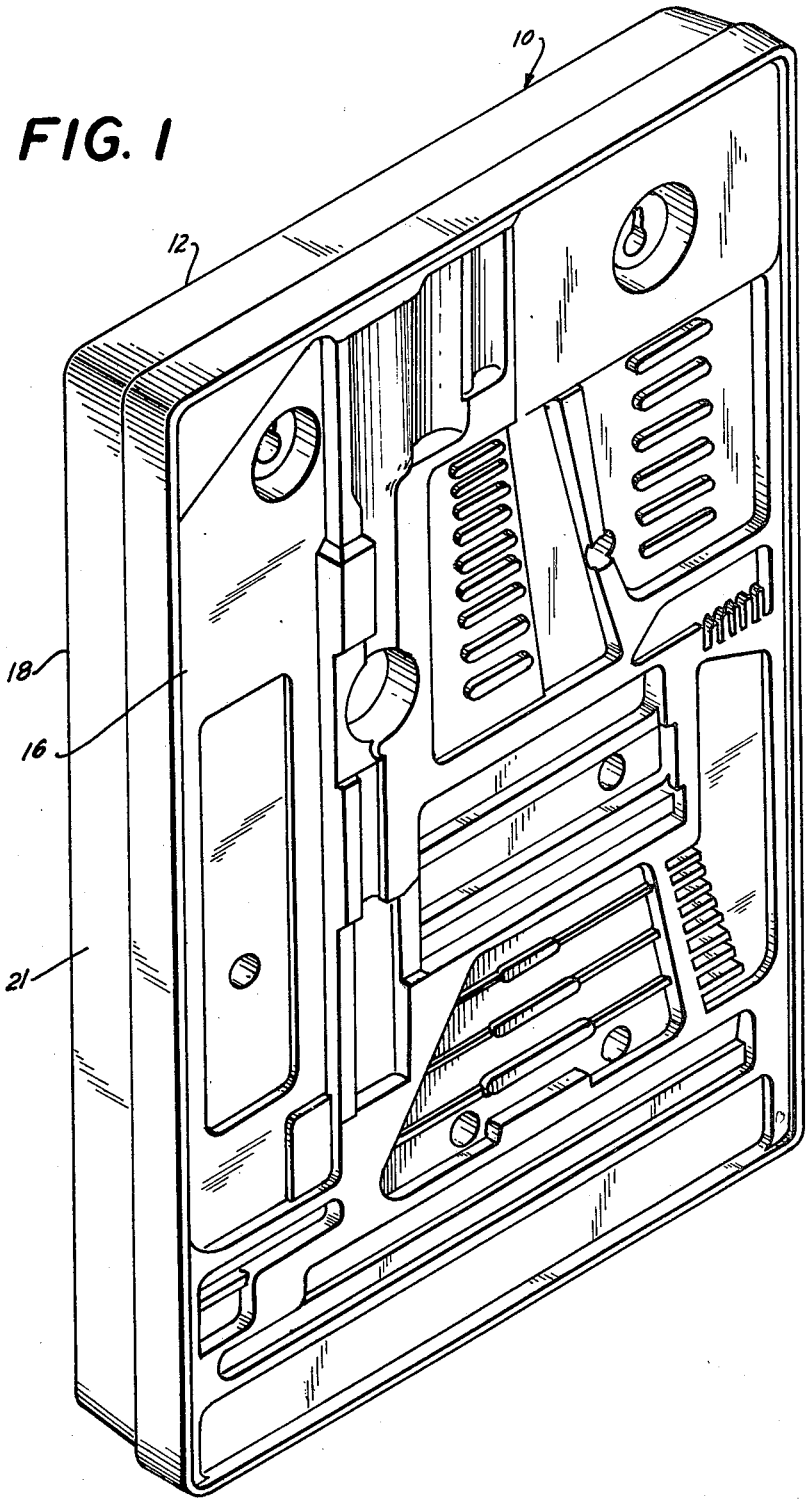
FIG. 1 is a top plan view of a display case constructed in accordance with the present invention.
Figure 2:
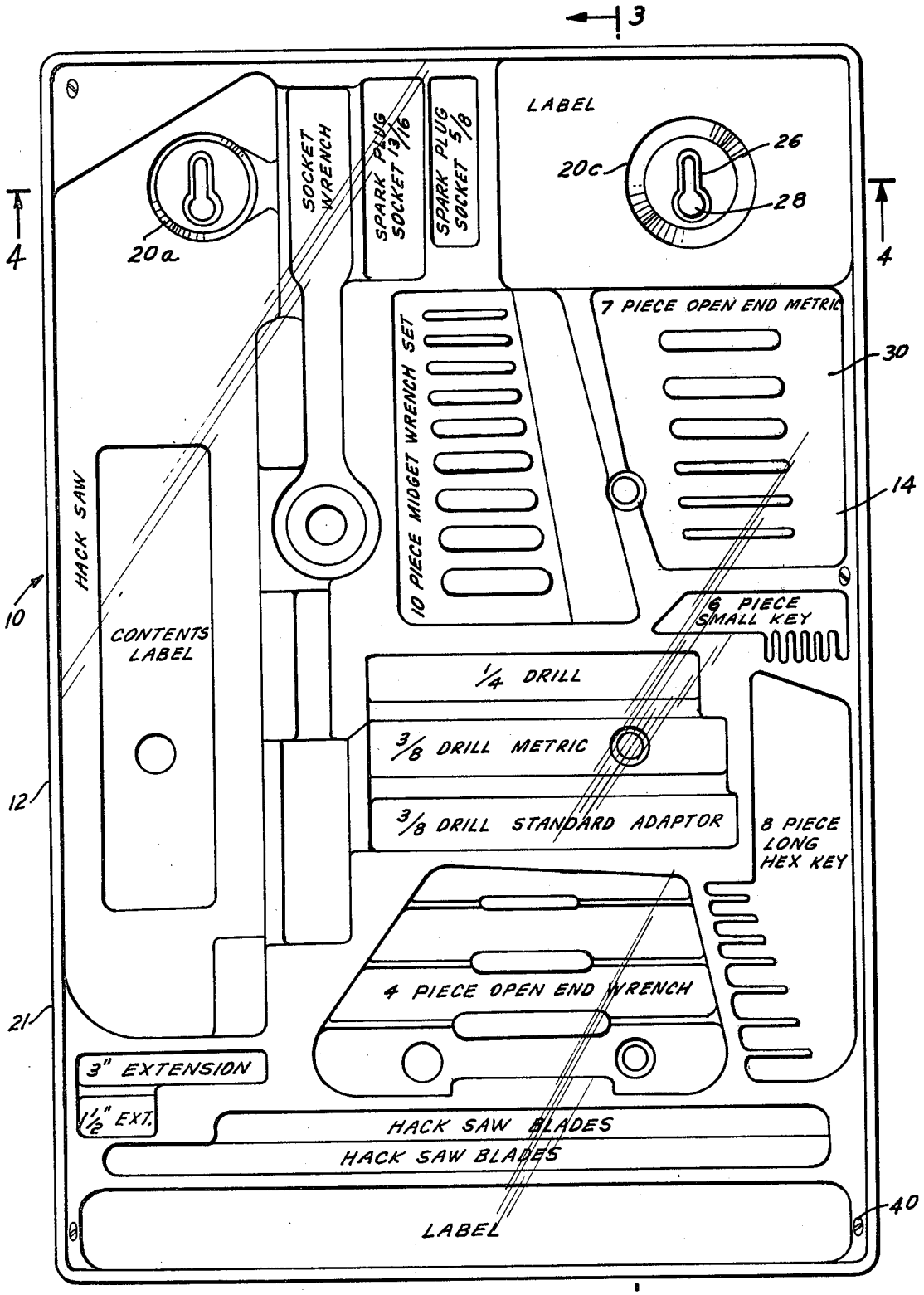
FIG. 2 is a perspective view of the display case shown in FIG. 1, with the cover removed.

Referring now to the drawing in detail and initially to FIGS. 1 and 2 thereof, a combination package and display case 10, constructed in accordance with the present invention includes a base 12 and a transparent cover 14 secured to the base. The latter is formed in a blow molded plastic construction in the conventional manner, between two dye halves, and has an upper wall 16, a lower wall 18, and a peripheral side wall 20. The die halves are cut to form the various depressions in the upper and lower walls of the base during the blow molding operation.

Figure 3:
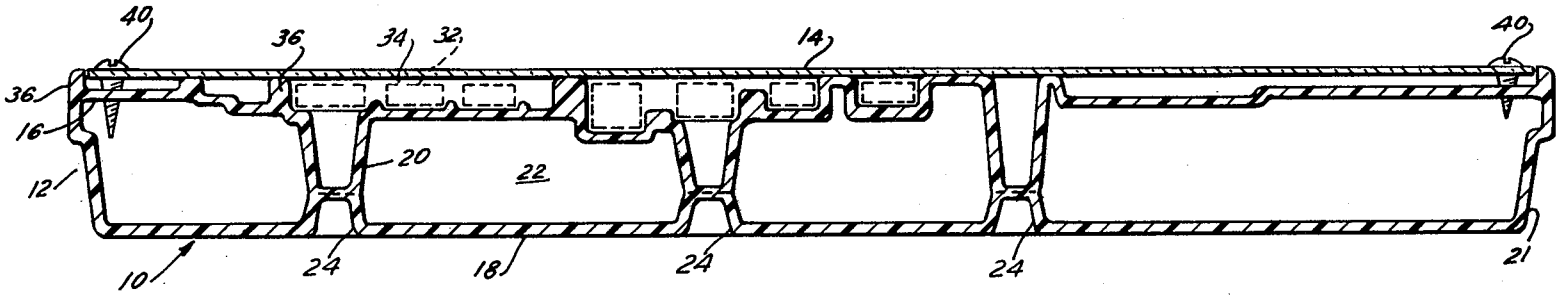
FIG. 3 is a sectional view taken along line 3—3 of FIG. 1.
Figure 4:
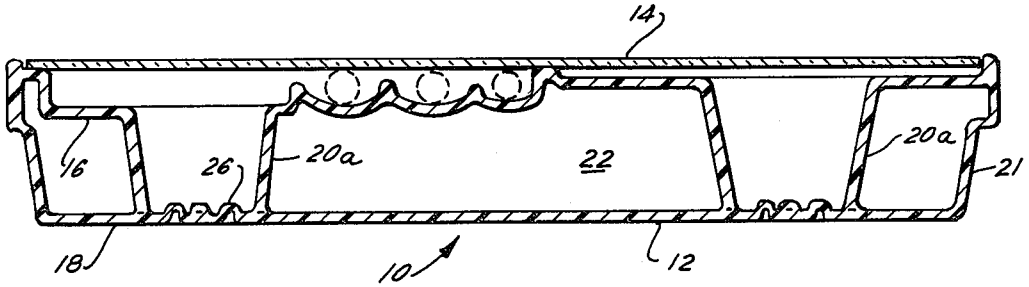
FIG. 4 is a sectional view taken along line 4—4 of FIG. 1.

The upper wall or surface 16 of base 12 has two different types of sets or recesses or depressions formed therein. One set of recesses consists of a plurality of conically shaped depressions 20 formed at pretermined locations throughout the surface of the base. These depressions include a plurality of narrow diameter frustro-conical depressions and two larger diameter depressions 20*a*. As seen in FIGS. 3 and 4, depressions 20, extend inwardly of upper wall 16 into the exterior 22 of base 12 towards bottom wall 18. They are met by corresponding smaller frustro-conical depressions 24, formed in bottom wall 18 and extending upwardly into the interior 22 of the base. The facing surfaces of the frustro-conical depressions 20, 24 are sealed to each other during the blow molding operation while the plastic is still in a soft, partially molten state. When the plastic has solidified, these depressions serve to rigidify the base so that the relatively thin upper wall 16 may support multiple relatively heavy components therein.

The larger frustro-conical depressions 20*a* are shown in greater detail in FIG. 4. These depressions extend to lower wall 18 of the base, and have wall or base portions which are sealed to lower wall 18 during the blow molding operation, as described above with respect to depressions 20 and 24. In addition, the die faces of the blow molding die are dimensioned such that the bases of depressions 20*a*, and bottom wall, form key hole grooves or recesses 26 in the bottom of each depression, having a thinner thickness than the remainder of the base wall. This defines a key hole shaped knock-out 28 in the base of each of the depressions. By this arrangement, the frustro-conical depressions or columns 20*a* serve to reinforce the base, while also providing an area at which the base can be mounted on nails, hooks or the like, for support as a display case on a wall or rack. It is noted that the thin grooved portions 26 of the key hole slots are hardened during the formation process, and resist tearing and rupture when used to support the display case.

Upper wall 16 of the combination package and display case of the present invention has a second set of depressions 30 formed therein. These depressions have a variety of different shapes and configurations selected to accommodate therein a number of different tool elements. FIG. 1 of the drawing has been marked with the identity of the various elements to be supported in depressions 30. For clarity, the tools themselves have not been illustrated.

Although a particular case construction 10 has been illustrated to accommodate a specific type of socket wrench and hacksaw set, it will be understood that the particular selection of the type of depressions 30 formed in upper wall 16 of the package can vary depending upon the type of articles to be stored and/or displayed in the particular package. In any case, the dimensions and depth of recesses 30 are selected, as illustrated in FIG. 3, such that the upper surfaces 32 of the tools received in the recesses (in this Figure the tools are illustrated in dotted lines) all lie on substantially the same plane 34. In addition, the portions of the upper wall 16 located between these depressions, provide support surfaces 36 also located on this same plane. Thus, the depressions 30 are dimensioned such that the tool surfaces do not extend above the depressions beyond the plane 34, i.e. beyond the upper surfaces of the support surfaces 36. These support surfaces are located throughout the upper surface of the base, and, as seen in FIG. 2, along most of the periphery of the base.

Peripheral wall 12 is, of course, integrally formed with the upper and lower walls 16 and 18 of base 10. The peripheral wall includes an upper lip 38 which extends slightly above plane 34, about the entire periphery of the base. Cover 14 is dimensioned to fit within the confines of lip 38 on support surfaces 36. Preferably this cover is formed of a transparent material, such as transparent plastic or glass, so that the tools are visible through it.

By this construction, cover 14 rests against the tools in depressions 30, while being supported throughout substantially the entire upper surface of the base by support surfaces 36. The cover is secured to the base by a plurality of sheet metal screws 40 or the like located throughout the base. By this arrangement the tools contained within the recesses are held against inadvertent removal from the recesses and against shifting in the base. Thus, the display case can be hung in a vertical position by means of key hole slots 28 for display at the merchandising center or store. In addition, the case can be used by the end purchaser as storage for the purchased tool set with the recesses 30 assuring neat storage for the tools and easy access to them.

Accordingly, it is seen that a relatively simply constructed blow molded combination package and display case is provided which can hold a plurality of tools against shifting in the case, while enabling them to be displayed in a vertical position. While the case is of lightweight plastic construction, it is relatively rigid due to the conical support columns therein, some of which serve the dual function of providing key hole slot supports for the case assembly.

Although an illustrative embodiment of the present invention has been described herein with reference to the accompanying drawings it is to be understood that the invention is not limited to that precise embodiment, and that various other changes and modifications may be effected therein by one skilled in the art without departing from the scope or spirit of this invention.

What is claimed is:

1. A display package and case comprising a blow molded plastic base having spaced upper and lower walls and a peripheral wall extending therebetween; said upper wall having a first set of a plurality of frustro-conical depressions formed therein open at the upper wall and having bases sealed to said lower wall of the base to provide reinforcement for said walls to rigidify said blow molded base, said upper wall having a second set of depressions formed therein of predetermined shape defining flat wall portions of said upper wall therebetween all lying on the same plane, said second set of depressions being dimensioned with respect to objects to be received therein such that the outermost surfaces of objects in the depressions lie in said plane, and a transparent cover panel secured to said upper wall and supported on said flat wall portions thereof to hold said objects in said depressions; at least one of said frustroconical depressions having a key hole shaped knock-out formed therein.

2. A display package and case as defined in claim 1 wherein said key hole shaped knock-out is defined by a key hole shaped area of reduced thickness formed in said base of said at least one frustro-conical depression.

3. A display package and case as defined in claim 2 wherein said base includes a peripheral lip surrounding said upper wall and said cover is dimensioned to fit within said lip.

4. A display package and case as defined in claim 3 including means for securing said cover panel to said base.

5. A display package and case comprising, in combination a blow molded plastic base having upper and lower surfaces, said upper surface having depressions formed therein separated by support surface portions lying in a common plane, said depressions having predetermined configurations selected according to the configuration of objects to be placed therein such that the objects extend above said surface no further than said plane, a transparent plate overlying said upper surface and lying on said surface portions to retain said objects in said depressions, said upper surface including at least one frustro-conical depression formed therein including a base portion sealed to said lower surface of the base and having a key hole shaped knock-out formed therein, thereby to rigidify said base while providing means for mounting the case.

* * * * *